United States Patent [19]

McDougal

[11] Patent Number: 4,785,641

[45] Date of Patent: Nov. 22, 1988

[54] DRAIN VALVE CONTROL FOR ICE CUBE MACHINE

[75] Inventor: Gregory S. McDougal, Two Rivers, Wis.

[73] Assignee: The Manitowoc Company, Inc., Manitowoc, Wis.

[21] Appl. No.: 86,854

[22] Filed: Aug. 19, 1987

[51] Int. Cl.[4] ..... F25C 1/04

[52] U.S. Cl. ..... 62/233; 62/347

[58] Field of Search ..... 62/348, 347, 233

[56] References Cited

U.S. PATENT DOCUMENTS

| | | | |
|---|---|---|---|
| 2,322,405 | 6/1943 | White | 236/11 |
| 2,775,100 | 12/1956 | Howe | 62/348 |
| 2,860,490 | 11/1958 | Taylor | 62/347 X |
| 2,887,852 | 5/1959 | Thomas | 62/348 X |
| 2,949,019 | 8/1960 | Roberts | 62/348 X |
| 3,045,445 | 7/1962 | MacLeod | 62/137 |
| 3,046,754 | 7/1962 | Kniffen | 62/135 |
| 3,233,417 | 2/1966 | Soderberg | 62/348 X |
| 3,791,163 | 2/1974 | Dickson et al. | 62/347 |
| 4,550,572 | 11/1985 | Schulze-Berge | 62/138 |

*Primary Examiner*—William E. Tapolcai

*Attorney, Agent, or Firm*—Leydig, Voit & Mayer

[57] ABSTRACT

An ice machine control having a dump valve in the water circulation system for diverting water from the mold so that the system is cleared of unwanted water at the start of an ice making cycle, while the ice mold is allowed to cool to well below freezing before water begins to circulate over the mold.

5 Claims, 1 Drawing Sheet

DRAIN VALVE CONTROL FOR ICE CUBE MACHINE

Figure 1:
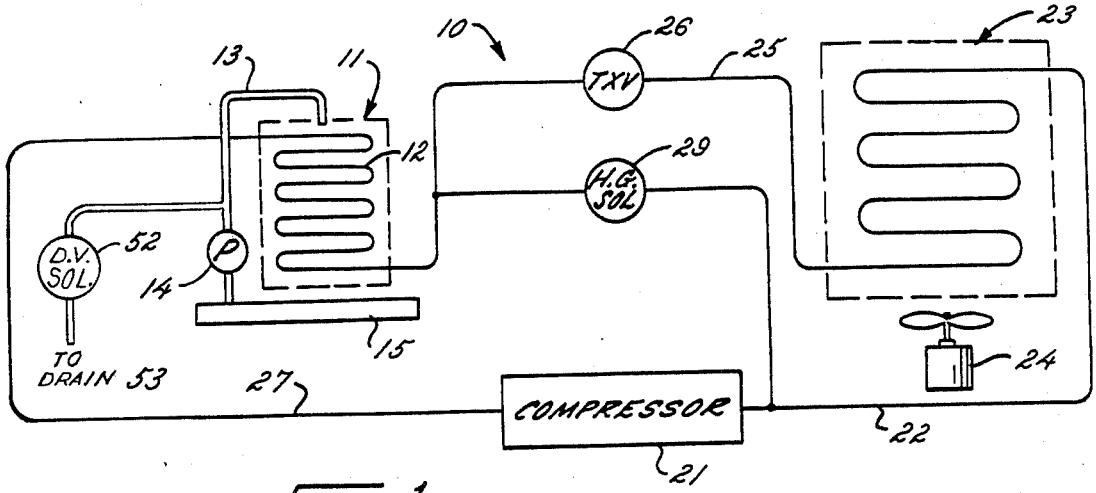

This invention relates generally to commercial ice making machines, and more particularly concerns a control for avoiding water flow blockage and for minimizing ice meltage.

A compression refrigeration ice maker has evaporator coils in close thermal contact with the ice forming mold. During the ice making cycle, refrigerant is evaporated in the coils to cool the mold to well below freezing, while water is pumped over the mold to build up the desired ice forms.

After the ice has formed, a typical ice maker goes into a harvest cycle in which water circulation is interrupted and hot gas from the compressor is directed through the evaporator coils to heat the mold and thus free the formed ice. After the harvest cycle, water circulation is resumed and the mold is again chilled to initiate a new ice making cycle.

At the start of each ice making cycle, mold temperature drops through water freezing temperature to the well-below freezing temperature at which ice is formed. Water circulating over the mold is not frozen at the very start of the cycle. As the mold cools, ice crystals are formed in the circulating water, creating an icy slush. Finally, the mold reaches the low temperature at which ice clings to the mold and the desired ice form is built up.

Commercial ice cube makers attempt to produce clear ice. This is accomplished by circulating water over the mold so that the water freezes from only one side. Since pure water freezes first, impurities are separated by the freezing process and removed from the surface of the ice by the circulating water. Eventually, the circulating water becomes highly concentrated with minerals and other impurities, and continued use of such water will ultimately produce cloudy or white ice. The minerals and impurities will also result in the rapid deposition of lime scale in the water circulation system, which will thus require frequent cleaning. It is, therefore, desirable to begin each ice making cycle with fresh water.

It has also been found that other problems relating to the water circulation system become greater as improvements are made in the refrigeration system to obtain faster freezing. U.S. Pat. No. 4,550,572 entitled Ice Machine Anti-Block Control, and assigned to The Manitowoc Company, Inc., identified and addressed some of these problems.

Increased cooling capacity apparently causes a greater volume of ice crystals to be initially formed and washed into the water circulation system. During the time ice crystals and the resulting slush are created, the ice crystals can clog and dam up the water circulation system or cause a condition in which water does not reach the pump. In both instances, the efficiency of the water circulation system is impaired.

U.S. Pat. No. 4,550,572 addressed these problems by the provision of a control circuit which causes the refrigeration system to cool down the mold to well below freezing at the start of an ice making cycle, before the water pump is energized to deliver water to the ice forming mold. As a result, when water begins to circulate over the mold, ice build-up begins immediately, thus checking the formation of ice crystals that can be washed away in an icy sludge to dam or block the water circulation system. Faster freezing, however, tends to produce cloudy or white ice, particularly when the recirculating water is not purged from the system at the start of each ice making cycle.

The Manitowoc Company, Inc., addressed this problem by the provision of a dump valve interposed in the water circulation system between the reservoir and the mold. The pump was then set to run continuously during the harvest cycle. During this time, the dump valve was opened and the recirculating water was drained from the machine.

This arrangement was found to have several shortcomings. In the event there is a restriction in the line through which the recirculating water is pumped out of the machine, or a restriction in the dump valve itself, some of the reservoir water will flow over the mold as it would during the freeze cycle, when the dump valve is closed. As a result, some of the harvesting ice would melt. This problem can be severe enough that at high operating temperatures the ice may melt so as not to harvest.

It was also found that the pump was operating for a longer period of time than required to empty the reservoir and, therefore, fresh water entering the reservoir was dumped to the drain. As a result, the quantity of water consumed by the ice machine was substantial.

Accordingly, it is the primary aim of the invention to provide a control mechanism which avoids the problems related to undue meltage and the formation of icy slush at the start of an ice making cycle.

Another object of the invention is to provide a control mechanism that is simple and economical, and which can be readily understood by the user of an ice making machine and easily adjusted for proper operation.

A further object of the invention is to provide a means to ensure that fresh water is used in each ice making cycle.

Figure 2:
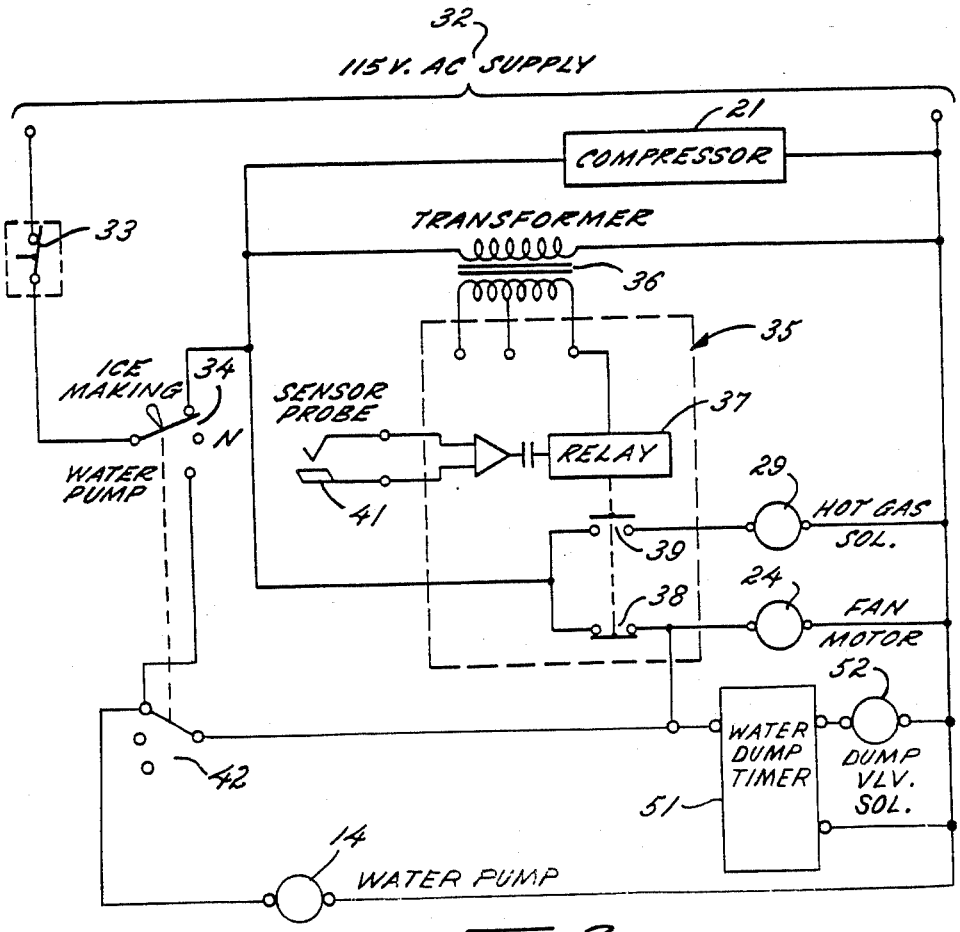

Other objects and advantages of the invention will become apparent upon reading the following detailed description and upon reference to the drawings, in which:

FIG. 1 is a schematic of the refrigeration system in an ice making machine; and FIG. 2 is a schematic of a control circuit for the system of FIG. 1.

While the invention will be described in connection with a preferred embodiment, it will be understood that I do not intend to limit the invention to that embodiment. On the contrary, I intend to cover all alternatives, modifications and equivalents as may be included within the spirit and scope of the invention as defined by the appended claims.

Turning to the drawings, FIG. 1 schematically shows an ice making machine 10 having an ice mold 11 cooled by evaporator coils 12 and supplied with water by a circulation system including a pipe 13, pump 14 and reservoir or sump 15. The refrigeration system that supplies refrigerant to the coils 12 includes a compressor 21, a discharge line 22, a condenser 23, a fan 24, a feed line 25 and an expansion valve 26. During the ice making cycle, gaseous refrigerant from return line 27 is compressed by the compressor 21, cooled to liquid state in the condenser 23, and, controlled by the expansion valve 26, the refrigerant evaporates in the evaporator coils 12, bringing the mold temperature to well below freezing. Thus water, delivered by the pump 14, flows over the mold 11 and builds up the ice forms shaped by the mold.

At the end of the ice making cycle, the pump 14 is stopped and hot gas is directed through a hot gas solenoid valve 29 so as to heat the mold 11 and free the formed ice. Melt water from the harvesting ice is collected in the reservoir 15. Because the pump is not operating during the harvest cycle, water from the reservoir cannot flow over the mold and, in this way, melt the harvesting ice. Once the ice is harvested, the ice making cycle is repeated.

The control circuit of FIG. 2 is shown in the ice making cycle position of the components. Current from a supply 32 passes through a closed harvest switch 33 and the contacts of a manual switch 34 to operate the compressor 21 and energize a control circuit 35 through a transformer 36. The circuit 35 includes a relay 37 and operating contacts 38 and 39. The relay is controlled by an ice sensing probe 41. In the ice making cycle, both the fan 24 and the water pump 14 are energized through the contacts 38 and, in the case of the pump 14, through a second set of contacts 42 of the manual switch 34. When the probe 41 detects completion of the ice making, the relay 37 is energized, opening contacts 38, thereby stopping the fan 24 and the pump 14, and closing the contacts 39 so as to energize the solenoid valve 29. When the ice is released, signifying the end of the harvest cycle, the released ice briefly opens switch 33 which momentarily deenergizes the entire circuit, dropping out relay 37, to restore the contacts 38 and 39 to the illustrated position. When the switch 33 closes, the ice making cycle restarts.

U.S. Pat. No. 4,480,441, issued Nov. 6, 1984, and assigned to the assignee of the present application, discloses the physical structure of the switch 33 and probe 41 in greater detail, and is specifically incorporated herein by reference.

In accordance with the invention, a water dump solenoid valve 52 is provided whereby the water delivered by the pump 14 from the reservoir 15 is diverted from pipe 13 to a drain 53. A dump timer 51 controls the transmission of current to the water dump solenoid valve 52.

When the pump 14 is energized at the start of an ice making cycle, the timer 51 activates the water dump solenoid valve 52 and water from the reservoir 15 flows to the drain 53. As the reservoir 15 is purged of melt water, fresh water is supplied to the system. At the end of an adjustable period of time, from 0–45 seconds, the timer 51 causes the dump valve 52 to close, and the fresh water is pumped through pipe 13 and over mold 11.

It has been found that diverting the flow of water from the mold 11 at the start of an ice making cycle permits the refrigeration system to cool down the mold 11 to well below freezing before water is delivered by pump 14. As a result, when water starts circulating over the mold 11, ice build up starts immediately and there is no stage of forming ice crystals that are washed away and which result in an icy slush in the reservoir 15 that could dam or block the water circulation system.

The water dump valve 52 in combination with the water dump timer 51 is also an efficient arrangement by which the system may be purged of reservoir water at the beginning of each ice making cycle while the mold is cooled to an effective temperature for the formation of ice. Fresh water therefore circulates over the mold in each new ice making cycle.

It will be appreciated that the inclusion of the water dump timer 51 and the water dump solenoid valve 52 are simple and economical additions to the ice making control circuit. Further, a user of the equipment can easily visualize the effect of setting the timer 51 and hence that portion of the control circuit can be easily adjusted for proper operation.

I claim as my invention:

1. In an ice making machine having separate ice making and ice harvesting cycles and having an evaporator and an ice mold, a water circulation system comprising a pump for circulating water over the mold during the ice making cycle, a reservoir for supplying water to the pump and for holding water which has flowed over the mold and fresh water that is added to the system, a circuit for stopping the pump at the end of the ice making cycle to preclude water from circulating over the mold and to initiate the ice harvesting cycle, a circuit for starting the pump at the end of the ice harvesting cycle to initiate the next ice making cycle, and means including a dump valve and a circuit for purging the reservoir of water that has flowed over the mold and for diverting the flow of water from the mold during the ice making cycle, the circuit including a timing device for opening the dump valve at the start of the ice making cycle so that the ice making cycle starts with a period for purging the reservoir of water that has flowed over the mold and for cooling the mold before fresh water is circulated thereover.

2. The combination of claim 1 in which the ice machine includes means for heating the mold during the ice harvesting cycle.

3. The combination of claim 1 in which the reservoir is disposed under the mold and collects melt water from the harvesting ice.

4. The combination of claim 1 in which the ice machine includes a compressor and a condenser to circulate refrigerant to the evaporator during the ice making cycle.

5. The combination of claim 1 in which the timing device is manually adjusted for the operative time the dump valve is open.

* * * * *